US010178879B2

(12) United States Patent
Glaser

(10) Patent No.: US 10,178,879 B2
(45) Date of Patent: Jan. 15, 2019

(54) E-CIGARETTES, E-CIGARS, VAPE-DEVICE PUBLIC SAFETY AND PROTECTION MECHANISMS

(71) Applicant: Lawrence F Glaser, Fairfax Station, VA (US)

(72) Inventor: Lawrence F Glaser, Fairfax Station, VA (US)

( * ) Notice: Subject to any disclaimer, the term of this patent is extended or adjusted under 35 U.S.C. 154(b) by 135 days.

(21) Appl. No.: 15/008,500

(22) Filed: Jan. 28, 2016

(65) Prior Publication Data

US 2016/0219932 A1 Aug. 4, 2016

Related U.S. Application Data

(60) Provisional application No. 62/109,246, filed on Jan. 29, 2015.

(51) Int. Cl.
*A24F 47/00* (2006.01)

(52) U.S. Cl.
CPC ..... *A24F 47/002* (2013.01)

(58) Field of Classification Search
CPC ..... A24F 47/002; A24F 47/004; A24F 47/04; A24F 47/008; A24F 13/00; A24F 1/00; A24F 7/04
USPC ..... 131/329
See application file for complete search history.

(56) References Cited

U.S. PATENT DOCUMENTS 4,227,540 A * 10/1980 Edison ..... A24F 13/06 131/187
5,353,814 A * 10/1994 Martin ..... A24F 13/00 131/175
5,495,859 A * 3/1996 Bowen ..... A24F 13/00 131/175
5,497,791 A * 3/1996 Bowen ..... A24F 13/00 131/175
6,234,169 B1 * 5/2001 Bulbrook ..... A61M 15/06 128/203.12
8,272,875 B1 * 9/2012 Jurmain ..... G06F 19/3437 434/236
8,653,942 B2 * 2/2014 Gibson ..... G06K 9/00013 340/5.52
9,717,276 B2 * 8/2017 Brammer ..... A24F 47/008
2007/0283971 A1 * 12/2007 Gidding ..... A24F 7/04 131/202
2008/0149118 A1 * 6/2008 Oglesby ..... A61M 11/047 131/194
2011/0240047 A1 * 10/2011 Adamic ..... A24F 1/00 131/328

(Continued)

*Primary Examiner* — Jean F Duverne
(74) *Attorney, Agent, or Firm* — Leslie R. J. Virany

(57) ABSTRACT

The present invention applies to vape type devices also known as e-cigarettes and e-cigars. In order to expand the acceptable use of Vape type devices, exhalation filtration is offered with a wider bore than the intake bore to permit a more comfortable exhalation. In order to avoid having to carry two devices, a Vape device and a filtration type device, the two are merged into one convenient device for portability, the larger exterior bore device to further act as a stand reducing table top foot print use and provision of the addition of some electronic features included for locating the device, theft avoidance and to electronically certify the user has diligently utilized the filter in public or regulated spaces.

20 Claims, 5 Drawing Sheets

(56) References Cited

U.S. PATENT DOCUMENTS

| | | | | |
|---|---|---|---|---|
| 2014/0286630 | A1* | 9/2014 | Buchberger | A61M 11/041 392/395 |
| 2015/0047661 | A1* | 2/2015 | Blackley | H05B 3/12 131/329 |
| 2015/0122252 | A1* | 5/2015 | Frija | A24F 47/008 128/202.21 |
| 2015/0181945 | A1* | 7/2015 | Tremblay | A24F 47/008 131/328 |
| 2016/0295917 | A1* | 10/2016 | Malgat | A24F 47/004 |
| 2017/0135408 | A1* | 5/2017 | Cameron | A24F 47/008 |
| 2017/0215482 | A1* | 8/2017 | Levitz | A24F 47/008 439/178 |

* cited by examiner

E-CIGARETTES, E-CIGARS, VAPE-DEVICE PUBLIC SAFETY AND PROTECTION MECHANISMS

BACKGROUND

Vaping uses auto combustion, so the user is not required to combust anything, cannot start a fire, can use Vape devices in bed. In part, these devices typically rely on human power for the movement of air. It's not a cigarette and it's not a cigar. There is an electrical or electronic element utilized to efficiently convert fluid to vapor and the vapor carries a scent and may also carry nicotine and other chemical agents.

Filtration was used successfully on cigarettes on the intake side to try to capture some of the tar and other harmful byproducts of combustion during inhalation. In Vape settings, filtration of the exhaled content is still a desirable feature protecting the surrounding environment. People and animals benefit from not having to share in inhaling the various contents of the Vape mechanism in use. Add to this thinking the high pluralities of Vape devices concentrated in a public space and the problem is better illuminated. In fact, Vape exhalation will affix to such things as carpet, cloth, curtains, seat covers, people's clothing, so it really is an issue. Also, the combined chemicals of a plurality of Vape type devices would be unknown, inclusive of the potential for illegal substances emitted into the air, where children will inhale them. This is unacceptable.

City, County, State and Federal law may eventually mandate all vaping devices to filter their exhaust, or, the public cannot use Vaping in public places. Carriers such as bus, train, plane, may mandate use of Vaping with filtration with or without the law mandating it, by way of patron demand.

Examples of prior art fail to provide a public-friendly vaping-type method of tobacco, or other substances traditionally consumed by smoking.

U.S. Pat. No. 5,160,518 Requires you to change exhalation paths. It used a U shaped tube to capture any excess smoke and pull it through. It never claims to get all the smoke, admits it can only get some of it. It is built around a miniature fan and requires power and the fan to operate. It suggests a method to filter exhalations, but without preventing an associated interference with the act of inhalation, thus greatly imposing on the user.

U.S. Pat. No. 6,814,083 monitors exhalation but does not provide means to reduce or eliminate dissemination of associated products into the environment.

U.S. Pat. No. 4,083,374 provides a method for reusing exhaled smoke by using a bag, but eventually allowing the bags contents to pass unimpeded and unfiltered into the environment.

SUMMARY

An important feature of the invention is to provide sufficient filtration for the exhaled portion in using a Vape type device. The filtration should be sufficient to cover a completely charged Vape type device through to the end of the device' capacity, or through several cycles if possible, based on the limits of the filter to where the filter must be replaced or cleaned. Other features including loss prevention, light, sound, use of the device as a stand, will be discussed below.

Vaping is not as nauseating to non using third parties as cigarette or cigar exhalation etc. . . . but it can still be very annoying and governments will pass laws prohibiting vaping in various settings. For example, no one even knows if a Vaping individual could cause harm to another individual who is allergic to the exhaled content. Bear in mind, the surrounding people do not have any warning as to if the Vapor carries nicotine, and certainly new mothers will not want their children to have to inhale nicotine. This invention can eliminate the exhalation content for the most part, 98% up to and including 100% very comfortably, so it seems certain that opinion as to where, when and how people Vape in public places could sway favorably for the Vaping public. The present invention provides a solution for the above and other problems associated with Vaping.

For purposes of this invention and as a non-limiting example, substances used for vaping are considered to include tobacco, nicotine, other legal "uppers", cannabis, (in places where legal) fruit, vegetable and spice-based smoking mixtures, legal drugs or combinations thereof. 'Vaping' is defined according to its common definition as referring to the heating or conversion to breathable aerosol, without combustion, of such substances for consumption extraction of resins, flavoring, or related components.

DETAILED DESCRIPTION

Figure 1:
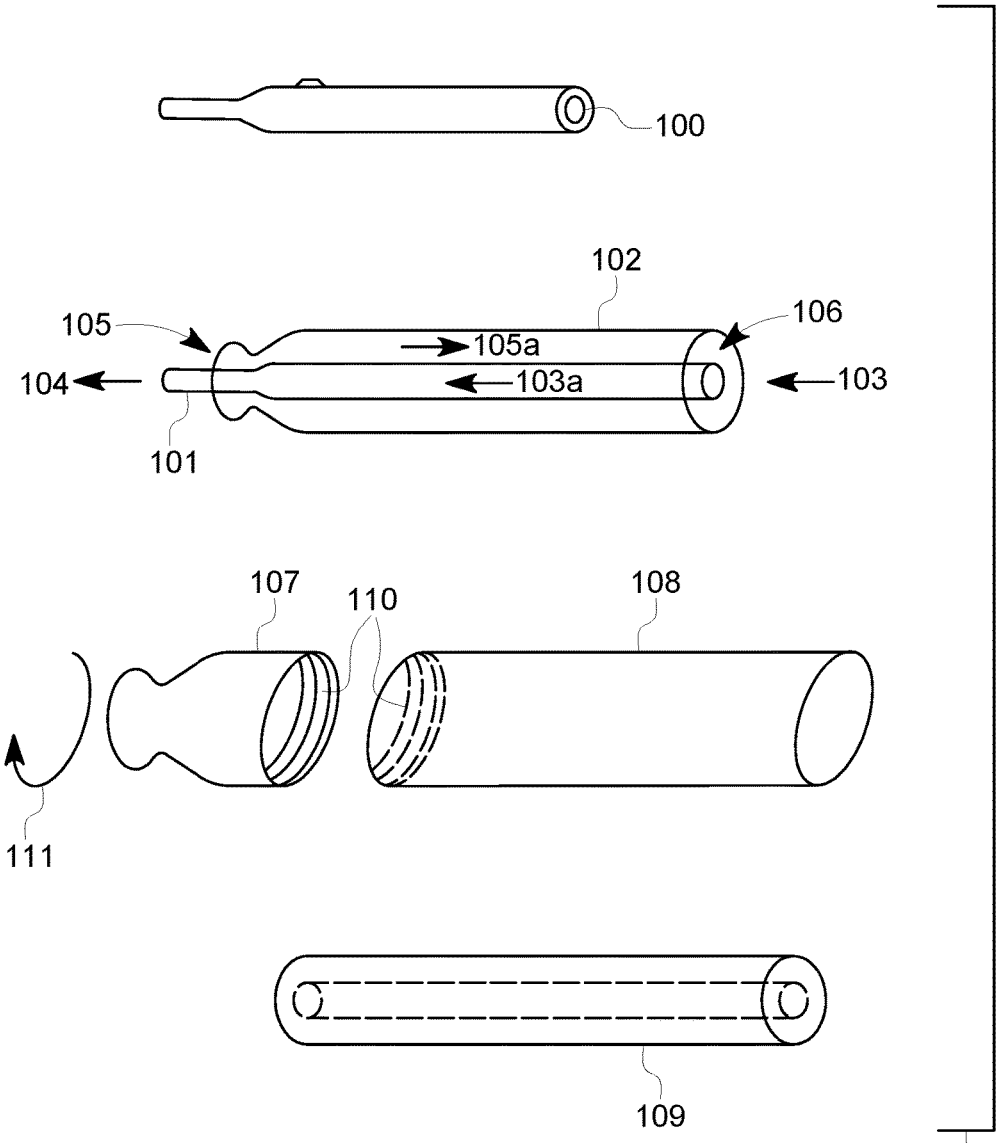
FIG. 1 Shows example of an e-cig 100 of the present invention.

Referring to FIG. 1, shown is an example of an e-cig 100 of the present invention having inhalation tip 101, external body 102 of a combined e-cig and filter, inhalation port 103, pathway and direction of inhalation flow 103*a*, inhalation point 104 where vapor enters the user, exhalation tip 105, exhalation pathway 105*a* and direction through filer where filter is not shown in this figure, exhalation port 106 and direction, one half of the filter housing 107, other half of a filter housing 108, fiber filter 109, screw threads 110, a direction 111 of force needed to couple the housing halves.

Referring further to FIG. 1, in accordance with the present invention, the e-cigarette also is used by the user to exhale through it. In a highly-preferred embodiment filtration of the user's exhalation occurs thereby. Using the same orifice and bore size that served the inhalation dose is not perfectly effective because it's too small a bore for exhalation, providing too much back pressure and the filter size would be reduced which has its obvious disadvantages. In this invention, blowing on the device pressurizes it, the filter is big enough to supply low additive pressure and most of the fumes would go through the filter, letting the air pass through the exhalation pathway 105*a*.

In a highly preferred embodiment, the filter 109 holds the two concentric tubes in place. Alternatively, the space between the tubes may be maintained by any support needed such as a plastic ring, metal ring, grid or other such strictly structural elements. An outer tip 105 exists around the inner tip 101 slightly deeper along the device and exhalation will switch the air flow either by having the user change tips for exhalation so as to reduce pressure by using a much bigger bore.

The present invention provides at least two pathways for air flow wherein the pathway toward the user 103*a* provides for vaporized substance while the pathway away from the user 105*a* provides, in at least an embodiment, for filtration utilizing one or more filtration means including but not limited to nano crystals, catalysts, liquids, solids, particulate filters, fibrous filters, carbon filters and other filtration mechanisms including electrostatic or electrolytic.

Figure 2:
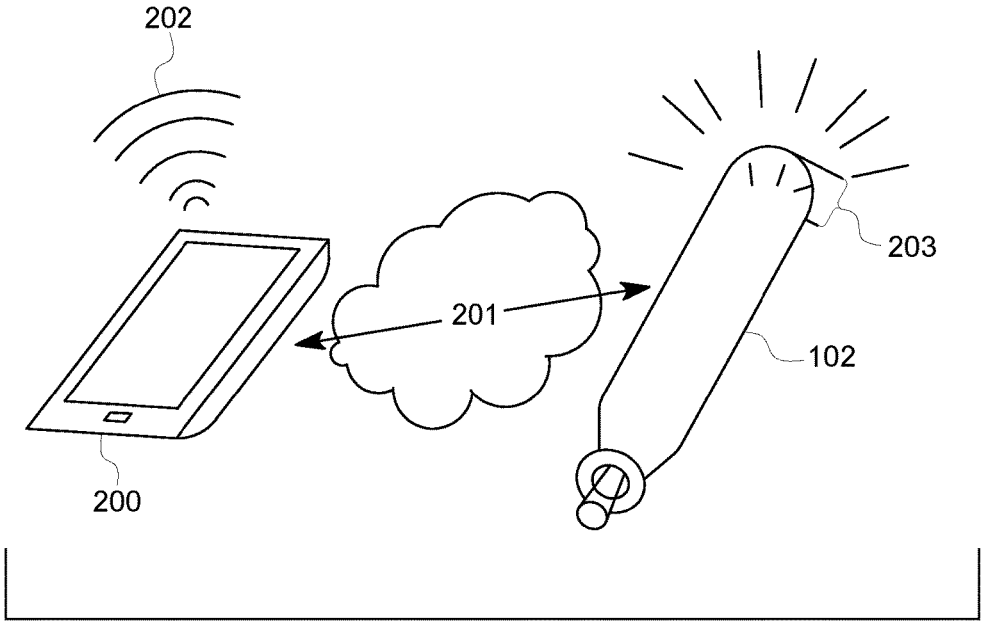
FIG. 2, in an embodiment, shows a cell phone 200 adapted for use with the invention depicted in FIG. 1.

Referring to FIG. 2, a generic cell phone 200 is shown having a wireless connection 201 between cell and e-cig of this invention 102, the wireless emissions 202 of the cell phone to various service providers such as 3-G network, 4-G network, Wi Fi, cellular, illumination 203 at tip which can also be at other places but not shown other than at the tip.

Figure 3:
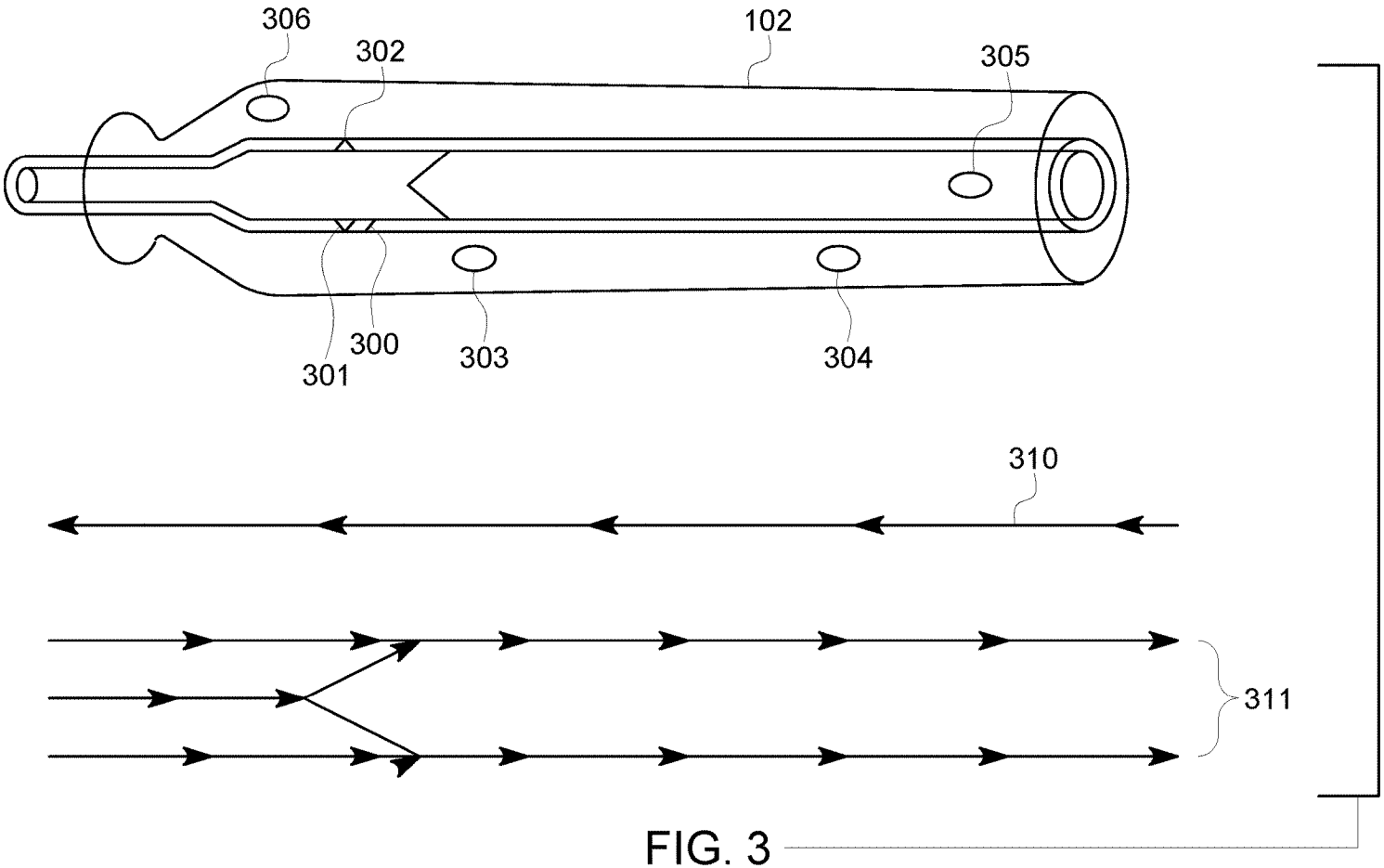
FIG. 3, in an embodiment, shows favoring the intake pathway through the use of an automatic one way valve with further automatic switching to an exhale pathway.

Referring to FIG. 3, In an embodiment, the user exhales through the smaller inhalation tip 101, causing a valve driven switching of airways to cause use of the filtration. An automatic one way valve 300 is shown favoring the intake pathway, one way valve 301 allowing pressure on the intake tip to be rerouted to the exhalation pathway, one way valve 302 allowing pressure on the intake tip to be rerouted to the exhalation pathway supplementing the first valve 301 for redundant operation, exhalation pathway sensor 303, exhalation pathway sensor 304, inhalation pathway sensor 305, exhalation pathway sensor 306, inhalation direction 310 through core of the device, exhalation direction 311 through the larger tip where any pressure on the smaller tip allows exhalation to be rerouted through valves to the exhalation pathway. Note that sensors are anticipated to sense pressure, volume, chemistry of the vapor and report this to any on board electronics (not shown). In an embodiment, sensors are placed in different placement and any one sensor may preferably be designed to perform as a dual or multi state or condition sensor. Sensor embodiments include a flow, direction and volume determining sensor.

Valves 300 & 301 are preferably multi-flap valves, similar to a mitral valve, composed of nylon or a material exhibiting appropriately similar properties, somewhat resembling a heart valve. It may be preferable for the flaps to be triangular. Alternatively, a spring tension ball valve may be used. It may be preferable for the spring to be of stainless steel construction, nano-engineered to have an adequately low spring constant to respond, as described above, to a force produced by the breath of the user.

In an embodiment, a filter and catalytic converter are added into the airway or air pathway of the exhalation. It may be preferable for the inhalation bore and chamber to have a pressure driven switch, to allow the exhalation to use the same pathway up to the point of switching. This serves to clear the minute remaining Vapor from the inner inhalation bore pathway.

Figure 4:
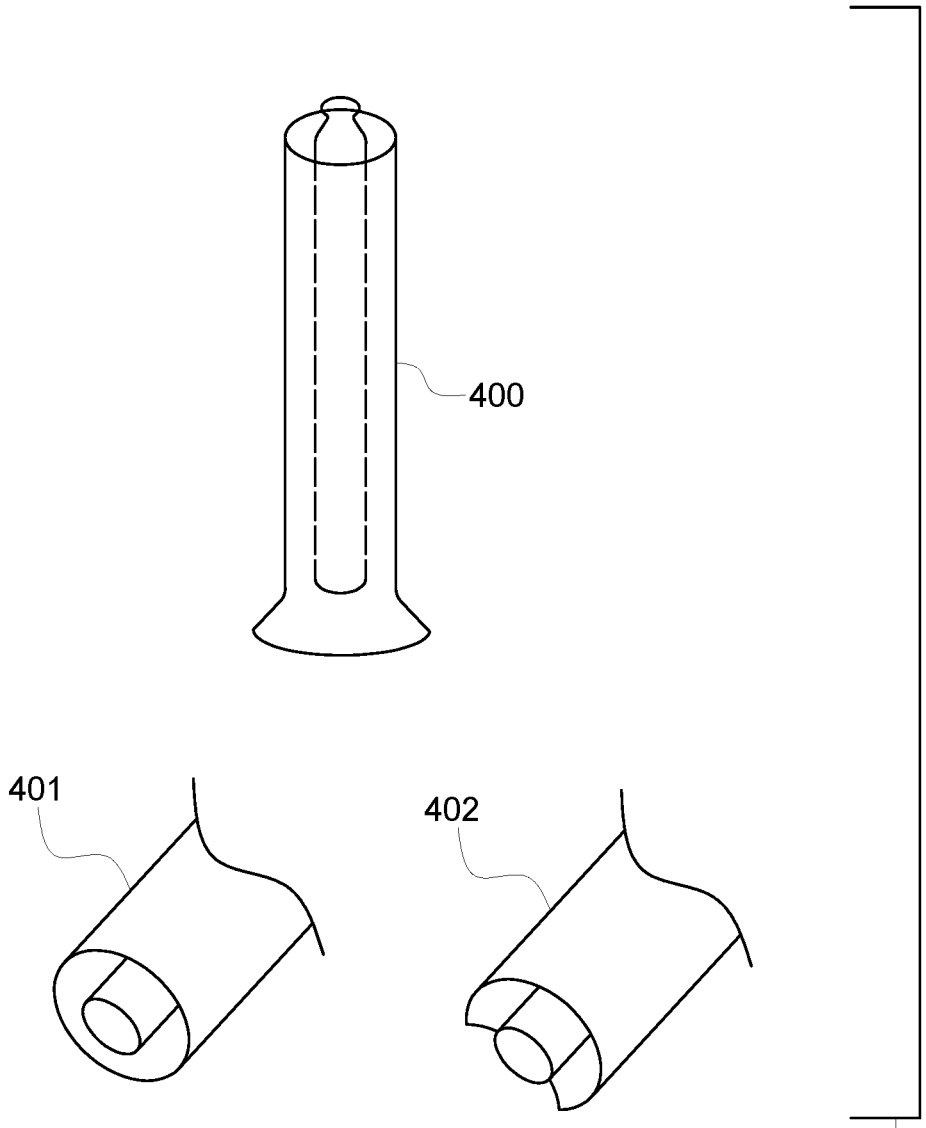
FIG. 4 shows the present invention, adapted for convenient use.

Referring to FIG. 4, in an embodiment, the present invention comprises a trumpet shape 400 you insert your cig into so a user could modularly convert any cig to this invention. The invention is contemplated for use either way, a separate item or built in on first purchase. Ecigs generally do not stand up. In an embodiment, the exhalation bell is a stand or doubles as a stand. This would slightly resemble a trumpet or trumpet shape. It may be preferable to add a counter weight to ensure balance. Also shown are elements 401, a regular tip and & 402, an alternative U shape which improves comfort for the user.

It may be preferable to add an RFID chip or bluetooth so as to mate it with your cell and watch, so you cannot lose the apparatus, as they may be expensive. A glow light for night time so you can see the end (vaping in bed, etc. . . . ) GPS locator, RFID locator, maybe disable it if its not on your person, such as x feet away from your cell or watch. Programmable, so you can set it to do different things from your watch or cell. Light and sound for locating it.

It may be preferable to provide an adapter so the device can charge from your cell battery or other portable electronics you have on your person.

It may be preferable to include a processor and sensors inside the vape device, to provide data to public systems assuring the vape user exhales the same volume of air they inhaled, through a filter that is functioning properly.

In an embodiment the present invention can be paired with other personal devices such that the distance between devices sets off an alarm at a preset distance. In an embodiment, when separated, the e-cig is disabled, so children who find it cannot operate it. The device pairing of the e-cig with another containing a display allows for the e-cig to communicate its status, report the filter percentage availability and any other parameters the e-cig has been equipped to report by way of sensors, processing and memory.

In an embodiment, the Vape device is paired with other electronics such that a display can run an application allowing for directional location of the "lost" e-cig of this invention utilizing such means as RFID circuitry contained within the e-cig and within the device seeking the e-cig, such as a cell phone equipped with RFID detectors and antenna'.

In an embodiment, the remote applications operated on such devices as a cell or tablet can cause the e-cig to illuminate, emit a sound or both and the illumination and sound can be changed from the application or, the e-cig of this invention can also initiate the sound or illumination or both. One such mode is an illuminated tip at either end or at both ends (or any portion of the e-cig desirable), to assist in locating or placing the device using the lighting to see where you wish to place the device during periods of ambient darkness. The app can have commands to cause the e-cig to emit sound or light, while the e-cig can have buttons for the issuance of the same commands or different commands.

In an embodiment, the e-cig of this invention can measure air flow of air in and out, allowing an on-board processor and memory (e-cig internal processing and memory) to calculate that the user has exhaled the same volume of air as was inhaled, to then provide this data electronically and wirelessly to external applications certifying the user is following local rules to protect bystanders who do not wish to inhale the vapor or any of its components. The accumulative effects of the vapor causing damage to surfaces, materials, clothing, upholstery and the like, are also avoided. The same sensors can detect if the e-cig of this invention contains a filter, if the filter is nearly full or otherwise needs to be changed or cleaned, including sensing escaping vapor which has not been as fully filtered as is possible with a known working filter.

In an embodiment, filtration may also include catalysts which convert exhaled chemicals to other chemicals. This may involve metals and metal plates, such as platinum or rhodium, to treat the exhaled portion of the vapor and convert or otherwise trap harmful chemicals. Other obvious filter components may include activated charcoal, carbon fiber, fibrous material and other high surface area filtration competent materials. Selection for biologically and environmentally safe materials is always a mandatory consideration. Recycling of the filters or devices can be encouraged and electronically enforced.

In an embodiment, the associated apps allow the user to calculate the total air flow in and out for informational purposes and in a "terms of service" (TOS) agreement, can be shared with external applications to see if a better deal for the device and its recyclable components, filters, consumables and distillates or additives can be found.

In an embodiment, the e-cig of this invention is biometrically activated and deactivated by the user such that the loss of the device does not result in other users utilizing the device, protecting the primary user from any claim of damage to a secondary user. In embodiments, this function is automatically activated and/or deactivated. Additionally, a simple password lock out feature could also be provided, wherein, if the device is turned off or its battery dies, or, if the distance from other user devices triggers the alarm, the device locks out. This protects such individuals as a minor from Vaping from the user's e-cig of this invention.

In an embodiment, the e-cig of this invention has circuitry which allows the device to put on a modest light show in sync with music playing in the ambient surround. This includes a mic, sound processing and visualizer software as well as processing, memory and ideally, multi-color Led backlighting or other forms of light source. In an embodiment, the same function is operated automatically across a group of users. In an embodiment, the e-cig of this invention networks with other e-cigs which surround the user by way of their unique user's electronic devices, to allow a network mapping of all the e-cigs in proximity to, for example, allow a master controller to create a light wave in a stadium under the control of an external application. It may be preferable for text or other graphics to be emitted, visible from a distance wherein each user represents a pixel or pixel group. In an embodiment, the successful logging into the e-cig of this invention wherein settings have allowed this feature, it may be preferable for the e-cig to emit a jingle (audible sound) and light pattern unique to the manufacturer of the e-cig.

In an embodiment, the e-cig of this invention uses a bio sensor to emit light which corresponds to a mood of the individual user. It may be preferable to have a setting to set a light which indicates the social availability of the user, such as single. This is of interest to users in social settings, such as a dance, a bar, a stadium or theatre lobby.

In an embodiment, the e-cig of this invention includes circuitry which networks with surrounding networks to enable features law enforcement and venue owners may appreciate, such as assurance users are using the devices where designated, users are exhaling through their device and the light or sound features are suppressed to avoid disturbing other users in the area with an override function to find a truly lost e-cig of this invention. This provides assurance in a movie theater setting, as one example, or on a commercial aircraft as another good example, the e-cig of this invention is not viewed as a nuisance or annoyance to other people in proximity.

In an embodiment, the outer casing containing the filter is fashioned to modularly fit over an existing pre-manufactured e-cig type device. Alternatively, the invention could function as a combined solution as illustrated herein, sold as a combined e-cig and filter system. In an embodiment, it may be preferable to filter on the inbound side for the user.

In an embodiment, e-cig operation is shut down by way of an agreed-upon standard to electronically signal such devices which work directly, or indirectly through an app on a cell phone or tablet to ask the user to shut down, while the system still has override capability and will forcibly shut down the Vape device. This would logically apply based on the user's location or per an agreement during travel for the device to auto operate and auto non-operate when and where the application allows, so the user still has some limited access.

In an embodiment, the combined e-cig filter device of this invention further includes valves which allow a comfortable inhalation, while combining two tips for exhalation, wherein the user selects the larger of the two concentric exhalation tips which still puts pressure and passes air through the smaller tip, invoking valves which assure all exhaled product goes through the filtration. In an embodiment sensors reflect the use of any substance outside of what the user programs in and/or the device senses and reports the use of each substance utilizing sensors to detect them. For example, a user owns a vaping device, which is stolen and hacked past security. The user finds out as the device reports it. Alternatively, as an example of a method of the present invention, the use of an illegal drug is detected by sensors and reported via WiFi.

In an embodiment, liquids used as filtration substances are displayed in a bulbous form wherein the form, used as a weight, keeps the device vertical when set down on a surface. Rather than a trumpet shape, the base could take on most any form that contains the liquid, and the liquid used for filtration need not be exclusive as to the filtration means, such as a two stage or three stage filtration device. The light emissions of the device could leverage the presence of the liquids to act as a transmission medium expanding the light emission volume. Note that on board processing, memory, battery, vape specifics or electronics, wireless transmission circuitry and antenna have not been shown as these elements are typically so small, they do not affect the overall design, or alternatively, they can easily be worked into the design as those skilled in the art of electronics CAD CAM understand, as well as those skilled in VVLSI, miniature electronics and 3-D Printing.

Figure 5:
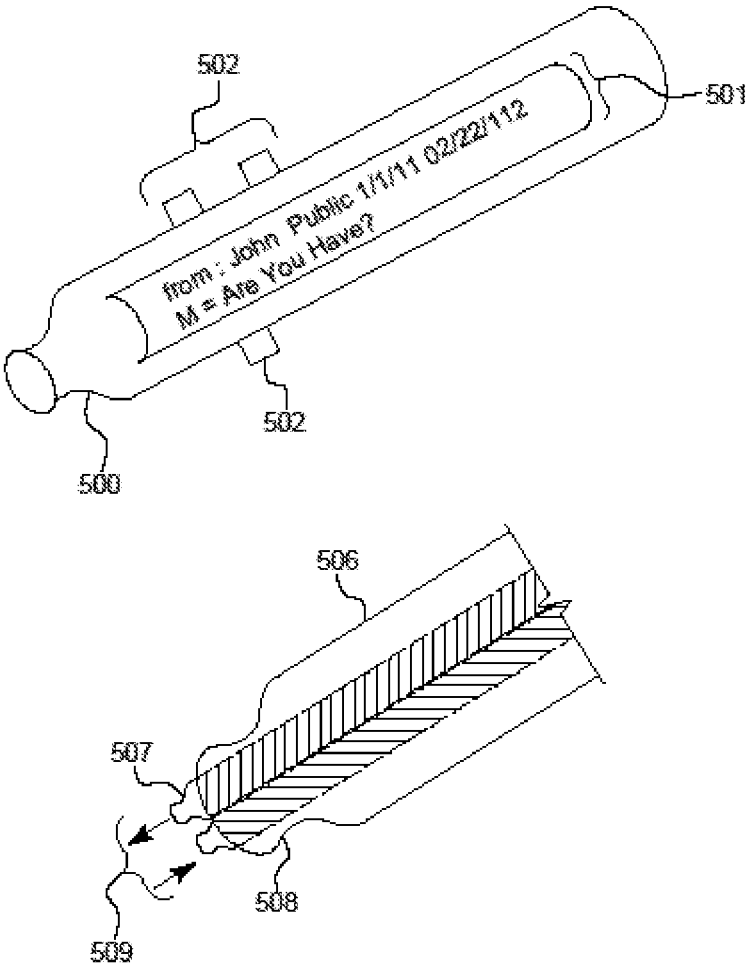
FIG. 5 Shows Vape device (500) with an integrated communications device including display (501) and control buttons (502). The control buttons could be associated with display elements causing them to act as soft keys in the context of changing their programming based on mode switching for the integrated communications device.

Referring now to FIG. 5, vape device (500) includes an integrated communications device with display (501) and control buttons (502). The purpose and intent of the integrated communications device (501) is to provide a local epaper-like connection to an electronic wrist watch, cell or tablet (laptop or desktop) or, in an alternative embodiment, to have its own network connection such as WiFi or Bluetooth, g5 carrier or other wireless type connections. The control buttons (502) may be hard, fixed in their functions or, they may re-designate their functions with or without help from the incorporated display. For purpose of this invention, a soft key function is a key placed close to the display such that the key may be designated with text on the display as to the key's function at a given moment. Intuitively, aside from providing status information about the device and its associated filter (when an exhale filter system is included), the communications device may provide aural and vibrating notice of arriving communications including such communication forms as text, IM, Email, wherein reply may be automated and performed through pre-canned replies that can be called up, scrolled through and sent with the associated control buttons (502). Other local devices the user owns can sync up to this function, such as a digital wrist watch or cell phone, to allow the user to not have to deploy these other devices to casually reply to messages with the vape device (500) or elect to skip unimportant messages using the keys and associated functions (502). In another embodiment, the vape device can exhibit control over the other linked devices functions, such as to block further messages from these local devices, or, to auto respond to messages. Any function of the remote device, such as a cell, could be accessible, viewable, changeable and poll-able with the vape device (500) through its communications adaptor (501). To the limits of the display and electronics, this device may double as a digital wrist watch, cell, tablet, in terms of features and functions including the potential to use voice to text to respond to messages. Microphone not shown in drawings but logically, can be placed inside the vape device.

In another embodiment, dual vape device (506) which comprises the filter housing of the invention, may be internally equipped with two independent vape devices (507, 508) allowing for either a dual or double charge for both power and vaporizing content (flavorings, etc.) or, alternative content so as to add to the enjoyment and usefulness of the device. One such use could be prescription delivered drugs in one device, the other, casual flavorings used only for entertainment and enjoyment. Not shown is the incorporation of the communications device (501) with the dual vape device (506).

Also shown is a dual Vape device filter (506) comprising dual independent Vape devices (507. 508) which may be engineered to deploy with mutual exclusivity operating and locking in place in opposing directions (509).

It may be preferable to equip the device of the present invention, in order to talk to a network or local device, with COMM chips or specific types of networks such as 3-g 4-g 5-g wifi, bluetooth etc. It may also be preferable to equip the device to receive and respond to a message. Response to a communication could be accomplished with a voice response unit embedded in the vape device and made a part of it.

Those experienced in the field of this invention should, based on the detailed descriptions of the objectives and new methods, be able to understand the logical possible variations. They will be able to adopt appropriate strategies, dimensions and geometries depending on the various applications and needs of vaping devices, not specifically shown in this application, but within the general goals and objectives of this invention. Examples disclosed are intended to be limiting only as reflected in the claims.

The invention claimed is:

1. An e-cigarette device comprising;

an inhalation tip a first chamber with directional air flow allowing for the inhalation, through said inhalation tip, of air containing additive smoking or vaping substances, said first chamber having a bore, an exhalation tip surrounding said inhalation tip and connected to a second chamber for exhalation, said second chamber having a greater bore than said first chamber and surrounding said first chamber; and separation means disposed intermediately between said first and second chamber and maintaining said first chamber in fixed concentric relation within said second chamber and wherein further;

said first chamber comprises a bore sizing which provides a comfortable draw and flow of inhaled air and Vapor additive said second chamber comprises a bore sizing which facilitates a comfortable exhalation, said second bore comprising a greater overall bore size and reduced back pressure.

2. The e-cigarette device of claim 1 wherein said separation means comprises a filtration means.

3. The e-cigarette device of claim 2 further comprising at least one valve wherein the exhalation of air reverses air flow, causing said valve to close, forcing air into the second chamber.

4. The e-cigarette device of claim 1 further comprising means to permit free-standing when disposed on said end and wherein said means to permit free-standing comprises an exhalation bell having a substantially trumpet form flared at an end of said device distal to a user during use.

5. The e-cigarette device of claim 4 further comprising a second filtration means collecting filtered material in a liquid contained in a reservoir and wherein said means to permit free-standing comprises a base of said reservoir.

6. The e-cigarette device of claim 3 further comprising a switch to automatically change the position of said at least one valve.

7. The e-cigarette device of claim 2 wherein said second chamber further comprises catalytic conversion, effectively filtering the exhaled content to the exterior of said device.

8. The e-cigarette device of claim 3 wherein said at least one valve is selected from the list of a ball valve or a flap valve.

9. The e-cigarette device of claim 8 comprising a flap valve, wherein said flap is constructed of nylon.

10. The e-cigarette device of claim 9 wherein said flaps are substantially triangular.

11. The e-cigarette device of claim 8 wherein said ball valve comprises a nano-engineered spring adequately low spring constant to respond to a force produced by the breath of a user.

12. The e-cigarette device of claim 11 wherein said spring comprises stainless steel.

13. The e-cigarette device of claim 1 further comprising an adapter to charge from a mobile communication device.

14. The e-cigarette device of claim 1 further comprising RFID transmission system or bluetooth so as to mate with a mobile device such that the distance between devices sets off an alarm at a preset distance.

15. An e-cigarette device according to claim 1 further comprising a processor and wherein said second chamber is connected to an exhalation sensor.

16. The e-cigarette device of claim 15 wherein said first chamber is connected to an inhalation sensor and further comprising a unit, adapted to run on said processor, for providing data collected from one of said sensors, to a networked system.

17. The e-cigarette device of claim 15 further comprising at least one output device selected from the list of display or speaker.

18. The e-cigarette device of claim 15 further comprising a unit for biometric activation and deactivation by the user.

19. The e-cigarette device of claim 16 wherein said networked system is connected to a second vape device.

20. An e-cigarette device comprising;

an inhalation tip a first chamber comprising an existing pre-manufactured e-cig type device with directional air flow allowing for the inhalation, through said inhalation tip, of air containing additive smoking or vaping substances, said first chamber having a bore, an exhalation tip surrounding said inhalation tip and connected to a second chamber for exhalation, said second chamber having a greater bore than said first chamber and surrounding said first chamber; and separation means disposed intermediately between said first and second chamber and maintaining said first chamber in fixed concentric relation within said second chamber and wherein further;

said first chamber comprises a bore sizing which provides a comfortable draw and flow of inhaled air and Vapor additive said second chamber comprises a bore sizing which facilitates a comfortable exhalation, said second bore comprising a greater overall bore size and reduced back pressure said second chamber is adapted to serve as an outer casing modularly fitting over said first chamber.

* * * * *